United States Patent [19]

Uehara et al.

[11] Patent Number: 4,473,090

[45] Date of Patent: Sep. 25, 1984

[54] HYDRAULIC POWER SYSTEM FOR IMPLEMENT ACTUATORS IN AN OFF-HIGHWAY SELF-PROPELLED WORK MACHINE

[75] Inventors: Kazuo Uehara; Kiyoshi Shirai, both of Tokyo, Japan

[73] Assignee: Kabushiki Kaisha Komatsu Seisakusho, Tokyo, Japan

[21] Appl. No.: 310,423

[22] Filed: Oct. 9, 1981

[30] Foreign Application Priority Data

Oct. 9, 1980 [JP] Japan ..... 55-140565

[51] Int. Cl.[3] ..... F15B 11/16; F15B 13/06

[52] U.S. Cl. ..... 137/114; 60/421; 91/28; 91/31; 91/514

[58] Field of Search ..... 60/421, 422, 426, 427, 60/420, 430, 428; 91/28, 31, 514, 516, 517, 518; 137/114

[56] References Cited

U.S. PATENT DOCUMENTS

| | | | |
|---|---|---|---|
| 2,643,516 | 6/1953 | Carlson | 60/421 X |
| 2,879,612 | 3/1959 | Schultz et al. | 60/421 X |
| 3,410,295 | 11/1968 | Malott | 137/114 |
| 3,455,210 | 7/1969 | Allen | 91/446 |
| 3,535,877 | 10/1970 | Becker et al. | 60/421 X |
| 3,662,548 | 5/1972 | Suzuki et al. | 60/422 |
| 4,044,786 | 8/1977 | Yip | 60/422 |

*Primary Examiner*—Irwin C. Cohen

*Attorney, Agent, or Firm*—Armstrong, Nikaido, Marmelstein & Kubovcik

[57] ABSTRACT

All but the circle drive motor of the implement actuators of a motor grader are divided into two groups each consisting of those which need not be operated simultaneously. The power system has three fixed displacement pumps for driving the circle drive motor via a circle control valve and the two implement actuator groups via respective implement control valve arrangements of carry-over parallel configurations. One of the pumps is connected to the two implement control valve arrangements via a restriction and a flow divider. A first demand valve controls communication between the other two pumps and the implement control valve arrangements in response to the pressure differential across the restriction, maintaining constant fluid flow to the valve arrangements regardless of engine speed or the loads on the implement actuators. A second demand valve likewise responds to a pressure differential across another restriction formed in a conduit communicating the first demand valve and the carry-over ports of the implement control valve arrangements with the circle control valve, maintaining constant fluid flow thereto.

7 Claims, 10 Drawing Figures

HYDRAULIC POWER SYSTEM FOR IMPLEMENT ACTUATORS IN AN OFF-HIGHWAY SELF-PROPELLED WORK MACHINE

BACKGROUND OF THE INVENTION

This invention relates to a hydraulic power system for implement actuators in off-highway self-propelled work machines such as construction and industrial vehicles. The hydraulic power system according to the invention is particularly well suited for use in a motor grader or the like which requires operation of two or more implement actuators at the same time.

In a motor grader, for example, as it performs soil spreading, ditching and other duties usually assigned thereto, the need often arises for simultaneously effecting two or more of such implement operations as the shifting and swinging of the blade and the lifting or lowering of its lateral ends. The conventional implement control system in a motor grader has had several drawbacks. One of these is that when the opposite side ends of the blade are loaded to different degrees, they have been liable to be raised or lowered at different speeds. Also the revolving speed of the circle carrying the blade has been rather too low in some cases, resulting in unsatisfactory production. A further problem arises as when the vehicle is slowed down, and the implement assembly operated at the same time, to avoid its collision with some obstacle. The implement assembly has often been unable to clear the obstacle because its speed has decreased in step with reduction in engine speed.

An obvious remedy for all such inconveniences might be to employ hydraulic pumps of greater displacement. This measure, however, would inconveniently increase the operating speed of the blade and other implement actuators and thus adversely affect the performance of the machine. If the operating speed of the implement actuators were hydraulically reduced, then substantail waste of energy would result, and the hydraulic fluid and the actuators might overheat with operation for an extended length of time.

SUMMARY OF THE INVENTION

The present invention seeks to provide an improved hydraulic power system capable of driving implement actuators at constant speed irrespective of loads thereon or engine speed and hence to eliminate the inconveniences and difficulties heretofore encountered in off-highway self-propelled work machines of the class defined. The invention also seeks to reduce waste of horsepower to a minimum.

Stated in brief, the hydraulic power system according to this invention includes a plurality of sources of hydraulic fluid under pressure for powering at least two implement control valve means. One of the pressurized fluid sources communicates with one of the implement control valve means via a restriction. In response to the pressure differential created across this restriction a first demand valve maintains constant fluid flow to said one implement control valve means by controlling communication thereof with the rest of the pressurized fluid sources. Also included is a second demand valve which maintains constant fluid flow to the other implement control valve means in response to a pressure differential across another restriction formed in a conduit communicating the first demand valve and a carry-over port of said one implement control valve means with said other implement control valve means.

In a preferred embodiment, in which the invention is adapted for use in a motor grader, said one implement control valve means comprises two implement control valve arrangements of carry-over parallel configurations, each for controlling a different group of implement actuators that need not be operated simultaneously. The other implement control valve means is a single valve for controlling a bidirectional circle drive motor. Three fixed displacement pumps are used as the pressurized fluid sources.

The above outlined power system permits delivery of the pressurized fluid to the two implement control valve arrangements, which are in parallel connection, and to the circle control valve at constant rates, unaffected by the speed of the engine driving the pumps or by the loads on the implement actuators. This holds true either when any one, two, or all of the implement control valve arrangements and the circle control valve are manipulated simultaneously. Further, even though the circle drive motor demands greater input flow than the other implement actuators, the second demand valve functions to supply the required input thereto from two or all of the pumps. Thus the invention overcomes all the noted inconveniences and difficulties of the prior art. The invention also offers the advantage of economizing pump output since one or two of the pumps are automatically unloaded, i.e., communicated with the fluid drain, as the engine speed increases.

The above and other features and advantages of this invention and the manner of attaining them will become more apparent, and the invention itself will best be understood, from a study of the following description of the preferred embodiment illustrated in the attached drawings.

DESCRIPTION OF THE PREFERRED EMBODIMENT

Figure 1:
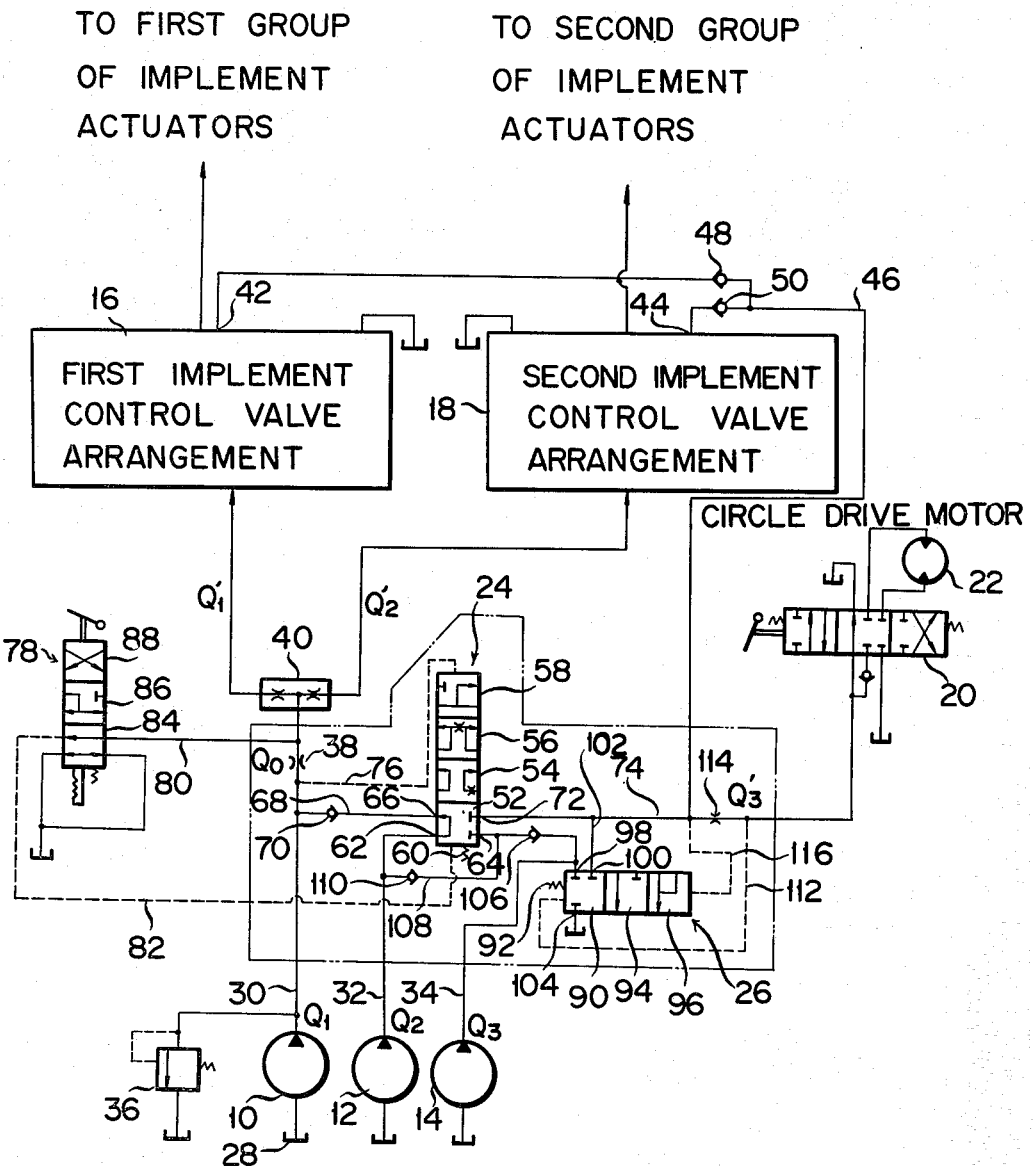
FIG. 1 is a schematic representation of the hydraulic power system according to the present invention as adapted for use in a motor grader.

FIG. 1 of the above drawings illustrates the hydraulic power system of this invention as adapted specifically for a motor grader. In this embodiment the various known implement actuators of the motor grader other than the circle actuator are divided, by way of example only, into two separate groups each consisting of those which need not be operated simultaneously. Fluid delivery to the circle actuator, which demands a larger input than the other implement actuators, is controlled separately. The illustrated power system broadly comprises:

1. A plurality of, three in the illustrate embodiment, fixed displacement pumps 10, 12 and 14 for powering the implement actuators.

2. First 16 and second 18 implement control valve arrangements of carry-over parallel configurations for controlling the first and second groups of implement actuators respectively.

3. A further implement control valve 20 for controlling the circle actuator in the form of a bidirectional, fixed displacement hydraulic motor 22.

4. A first demand valve 24 for holding substantially constant the fluid flow from the pumps 10, 12 and 14 to the two implement control valve arrangements 16 and 18.

5. A second demand valve 26 for holding substantially constant the fluid flow from the pumps to the circle control valve 20.

Driven by the vehicle engine, not shown, the fixed displacement pumps 10, 12 and 14 draw hydraulic fluid from a reservoir 28 and force the fluid out into output conduits 30, 32 and 34 at flow rates Q1, Q2 and Q3, respectively. A relief valve 36 protects the output conduit 30 of the first pump 10 from overpressurization. The pressurized fluid from the first pump 10 is further limited by a restriction 38 and divided by a flow divider 40 into two separate flows directed to the implement control valve arrangements 16 and 18 of parallel connection. When these implement control valve arrangements are operated, the pressurized fluid is delivered therefrom to the desired one or ones of the two groups of implement actuators. When the valve arrangements 16 and 18 are in neutral, on the other hand, the pressurized fluid passes them, emerging from their carry-over ports 42 and 44 into a conduit 46 via check valves 48 and 50. The destination of the conduit 46 will be described later.

The first demand valve 24 is of the four-port, four-position, pilot-controlled, spring-offset type, having four working positions 52, 54, 56 and 58 and normally held in the illustrated first or lowermost position 52 under the bias of the spring 60. The four ports of this first demand valve are: (1) a first inlet port 62 for admitting the flow from the output conduit 32 of the second pump 12; (2) a second inlet port 64 for admitting the flow from the output conduit 34 of the third pump 14; (3) a first outlet port 66 open to a conduit 68 connected to the output conduit 30 of the first pump 10, at a point upstream of the restriction 38, via a check valve 70; and (4) a second outlet port 72 open to a conduit 74 leading to the circle control valve 20. When in the first position 52 the first demand valve 24 allows communication between first inlet port 62 and first outlet port 66 and closes the other ports 64 and 72. The other three positions 54, 56 and 58 of the first demand valve will be referred to in the subsequent description of operation.

Thus, when in the first position 52, the first demand valve 24 permits the output Q2 from the second pump 12 to join the output Q1 from the first pump 10 on the upstream side of the restriction 38 in the conduit 30. The fluid pressure on this upstream side of the restriction 38 is directed as a pressure signal to the upper end, as viewed in the drawing, of the first demand valve 24 by way of a pilot conduit 76.

The fluid pressure on the downstream side of the restriction 38, on the other hand, is directed to a directional control valve 78 by way of a branch conduit 80. When the valve 78 is open, as shown, the downstream fluid pressure is applied as a pressure signal to the lower end of the first demand valve 24, where the spring 60 is provided, by way of a pilot conduit 82. It is thus seen that the first demand valve 24 responds to the pressure differential created across the restriction 38 in the conduit 30, shifting among the four working positions 52, 54, 56 and 58 as dictated by the pressure differential.

Normally held in the first position 84 to allow communication between the conduits 80 and 82, the directional control valve 78 is manually moved to a second position 86 to block the conduit 80 and to a third position 88 to communicate the conduits 80 and 82 with the fluid drain. The functions of this directional control valve will also become apparent from the description of operation.

The second demand valve 26 is a three-port, three-position, pilot-controlled, spring-offset one, normally held in the first position 90 under the bias of the spring 92. The other two positions of this valve are designated 94 and 96. The three ports of the second demand valve 26 are: (1) a first inlet port 98 for admitting the flow from the output conduit 34 of the third pump 14; (2) a second inlet port 100 connected to a branch 102 of the conduit 74; and (3) an outlet or drain port 104 open to the reservoir 28.

When the second demand valve 26 is in the first position 90, as shown, its two inlet ports 98 and 100 are both closed. Consequently the pressurized fluid from the third pump 14 flows through a check valve 106 toward the first demand valve 24. When this first demand valve is also in its normal position 52, the fluid from the third pump 14 flows into a bypass conduit 108, having a check valve 110, connected to the output conduit 32 of the second pump 12, thus joining the output therefrom.

For operating the second demand valve 26 a pilot conduit 112 communicates its left hand end, where the spring 92 is provided, with the conduit 74 at a point downstream of a restriction 114. Another pilot conduit 116 communicates the right hand end of the second demand valve with the upstream side of the restriction 114. Also connected to the upstream side of the restriction 114 is the aforesaid conduit 46 extending from the carry-over ports 42 and 44 of the two implement control valve arrangements 16 and 18. The pressure differential across the restriction 114 acts on the second demand valve 26, causing same to move among the three positions 90, 94 and 96.

The circle control valve 20 is of the familiar six-port, three-position, spring-centered design. Operated manually, it can set the circle drive motor 22 into and out of rotation in either of two opposite directions.

OPERATION

The following operational description of the illustrated power system first assumes that the directional control valve 78 is in the open position 84, permitting communication of the branch conduit 80 with the pilot conduit 82. When the vehicle engine is running at low speed, the output Q1 from the first pump 10 is divided by the flow divider 40 and enters the first 16 and second 18 implement control valve arrangements at correspondingly low rates. The pressure differential across the restriction 38 in the first pump output conduit 30 is now so small that the first demand valve 24 remains in the first position 52 under the force of the spring 60. The pressurized fluid Q2 from the second pump 12 flows from its output conduit 32 into and out of the first demand valve 24 and, via the check valve 70, joins the output from the first pump 10 on the upstream side of the restriction 38. The output Q3 from the third pump 14 flows through the conduit 34 and 108, with their check valves 106 and 110, into the second pump output conduit 32. Thence the combined fluid from the pumps 12 and 14 flows as aforesaid into and out of the first demand valve 24 and joins the flow from the first pump 10.

As the three pumps 10, 12 and 14 deliver the pressurized fluid at an increasing rate with an increase in engine speed, the pressure differential across the restriction 38 gradually rises to such a degree as to cause displacement of the first demand valve 24 from the first 52 to second 54 position against the force of the spring 60. In this second position the first demand valve 24 still holds the first inlet port 62 in communication with the first outlet port 66 and additionally places the second inlet port 64 in communication with the second outlet port 72 via a restricted passage. Consequently, part of the output flow Q3 from the third pump 14 flows off into the conduit 74 leading to the circle control valve 20, resulting in a decrease in the flow toward the two implement control valve arrangements 16 and 18.

With a further increase in the engine speed, and in the flow rates of the pumps 10, 12 and 14, the pressure differential across the restriction 38 still rises to cause the first demand valve 24 to shift to the third position 56 against the bias of the spring 60. The first demand valve when in this third position allows communication between first inlet port 62 and first outlet port 66 and between second inlet port 64 and second outlet port 72, and further places the first inlet port 62 in communication with the second outlet port 72 via a restricted passage. The complete output Q3 from the third pump 14 and part of the output Q2 from the second pump 12 are therefore directed toward the circle control valve 20.

As is seen from the foregoing, the output Q3 from the third pump 14 and part of the output Q2 from the second pump 12 flow toward the circle control valve 20, instead of toward the implement control valve arrangements 16 and 18, at a rate increasing in step with an increase in the output fluid flow from the pumps 10, 12 and 14. Thus the first demand valve 24 functions to maintain substantially constant the flow rate of the fluid Qo passing the restriction 38. The fluid flow Qo downstream of the restriction 38 is divided by the flow divider 40 into Q1′ and Q2′ at a predetermined ratio, for delivery to the two implement control valve arrangements 16 and 18. When the flow rate of the output Q1 from the first pump 10 becomes higher than that of the predetermined flow rate, the Q1′ or Q2′ increases with the Q1.

Figure 2:
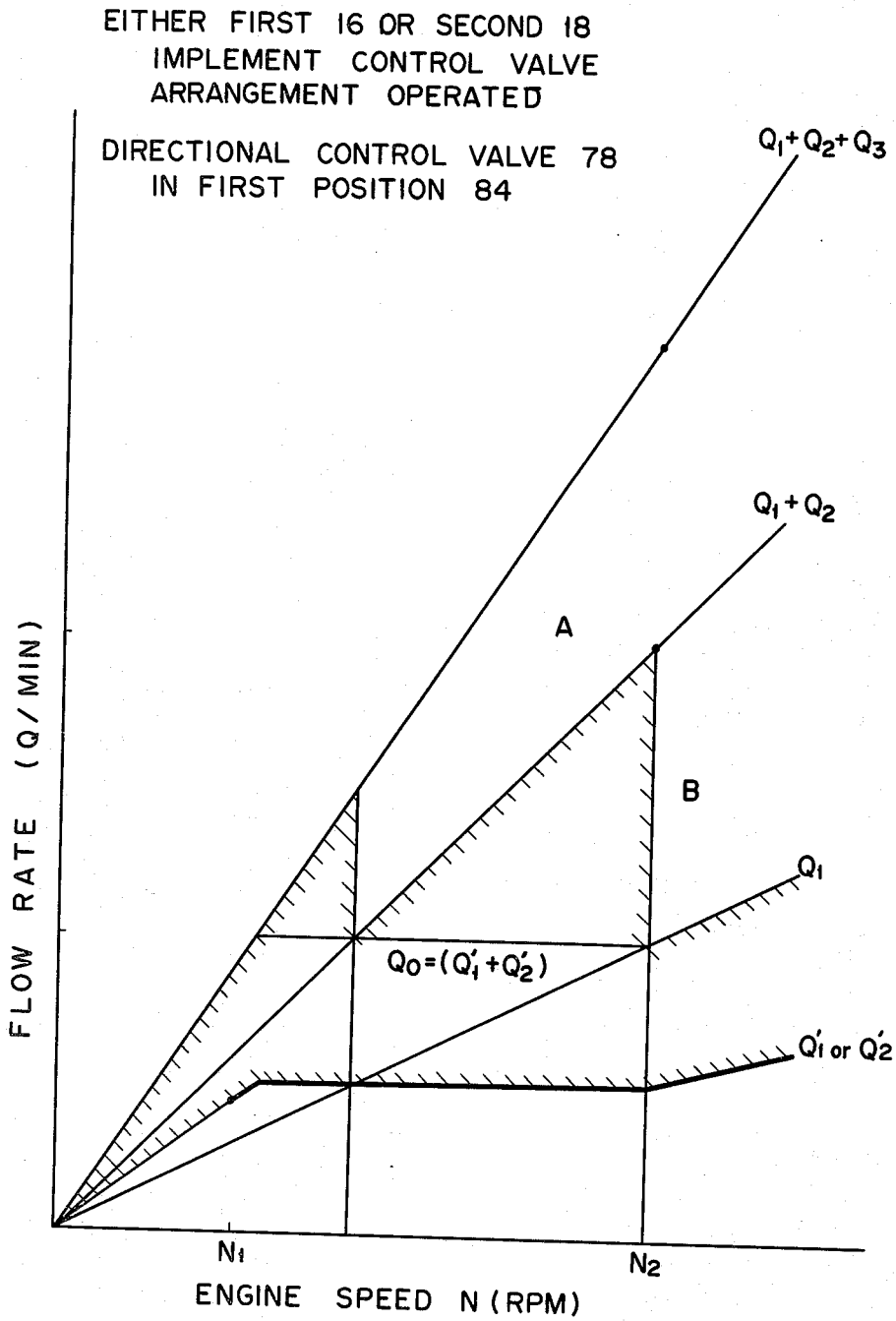
FIG. 2 is a graph explanatory of the performance of the power system of FIG. 1 when either of the first and second implement control valve arrangements is operated, with a directional control valve in the power system held in a first or normal position.
Figure 3:
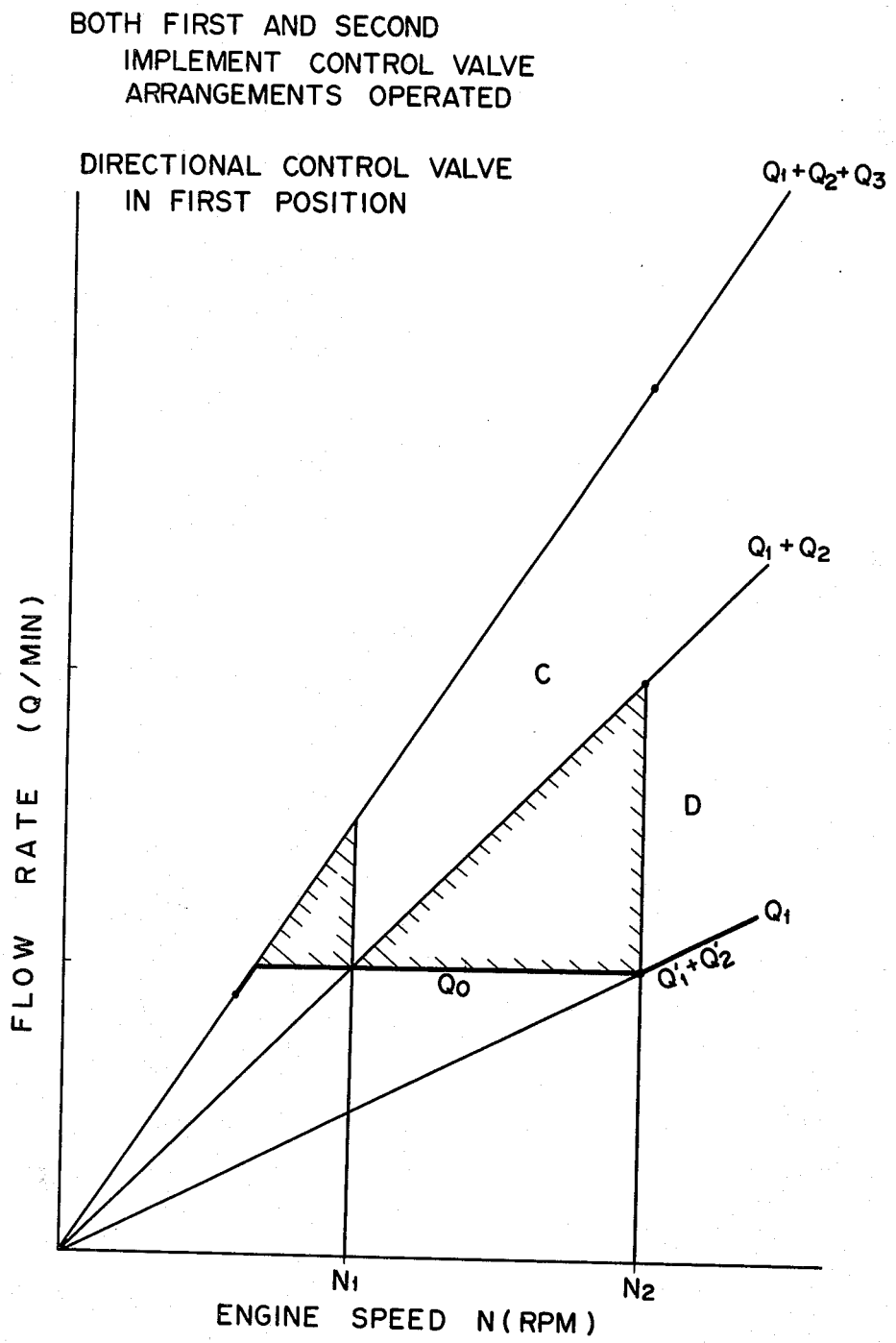
FIG. 3 is a graph explanatory of the performance of the power system when both of the first and second implement control valve arrangements are operated simultaneously, with the directional control valve in the first position.

FIGS. 2 and 3 graphically summarize the performance of this hydraulic power system as so far studied, FIG. 2 on the assumption that either of the implement control valve arrangements 16 and 18 is operated, and FIG. 3 on the assumption that both are operated. It will be observed from these graphs that the pressurized fluid can be fed into the implement control valve arrangements 16 and 18 at practically constant rates as indicated at Q1′ and Q2′, regardless of engine speed and the loads on the implement actuators. The operating speed of the implements under the control of the valve arrangements 16 and 18 is therefore unaffected by either engine speed or loads thereon. One of the advantages arising from this is that, even when engine speed is low, the implements can be manipulated swiftly to avoid collision with an obstacle. Also, when the opposite ends of the blade are loaded to different degrees, they can be moved up and down at equal speed.

The graphs of FIGS. 2 and 3 may further be explained as follows. When the engine rpm N is less than N1, the complete outputs Q1 and Q2 from the first 10 and second 12 pumps and part of the output Q3 from the third pump 14 are combined for delivery to the implement control valve arrangements 16 and 18. When the N is between N1 and N2, the output Q1 from the first pump 10 and part of the output Q2 from the second pump 12 are delivered in combination to the implement control valve arrangements, whereas the complete output Q3 from the third pump 14 is drained (assuming that the circle control valve 20 is not actuated). When the N becomes higher than N2, the complete outputs Q2 and Q3 from the second 12 and third 14 pumps are drained. Such partial or complete unloading of the second and third pumps significantly reduces waste of power, as indicated at A and B in FIG. 2 and C and D in FIG. 3.

Reference is again directed to FIG. 1 in order to discuss the performance of the illustrated power system when the implement control valve arrangements 16 and 18 are both in neutral. In this case the pressurized fluid flows into the conduit 74, leading to the circle control valve 20, from the carry-over ports 42 and 44 of the implement control valve arrangements 16 and 18 and from the second outlet port 72 of the first demand valve 24. As the fluid flow into the conduit 74 increases, the pressure differential across the restriction 114 therein rises to such an extent as to overcome the force of the spring 92 at the left hand end of the second demand valve 26, causing same to shift from the first 90 to second 94 position. The second demand valve 26 when in this second position places the third pump output conduit 34 in communication with the fluid drain, so that part of the output Q3 from the third pump 14 is drained. The branch 102 of the conduit 74 is still closed.

As the fluid flow into the conduit 74 further increases, the pressure differential across the restriction 114 rises correspondingly and causes the second demand valve 26 to move from the second 94 to third 96 position. In this third position the second demand valve communicates both inlet ports 98 and 100 with the drain port 104. The result is the complete unloading of the third pump 14 and the partial unloading of the second pump 12.

Thus, as far as the flow rate Q3′ of the pressurized fluid passing the restriction 114 in the conduit 74 is less than the sum of the outputs Q1, Q2 and Q3 from the three pumps 10, 12 and 14, the second demand valve 26 functions to maintain constant the pressure differential across the restriction 114. This means that the pressurized fluid can be delivered to the circle drive motor 22 at a constant rate irrespective of engine speed or load. If the sum of the pump outputs Q1, Q2 and Q3 is less than a preset degree, however, then the Q3′ is equal to the sum of the pump outputs.

Figure 4:
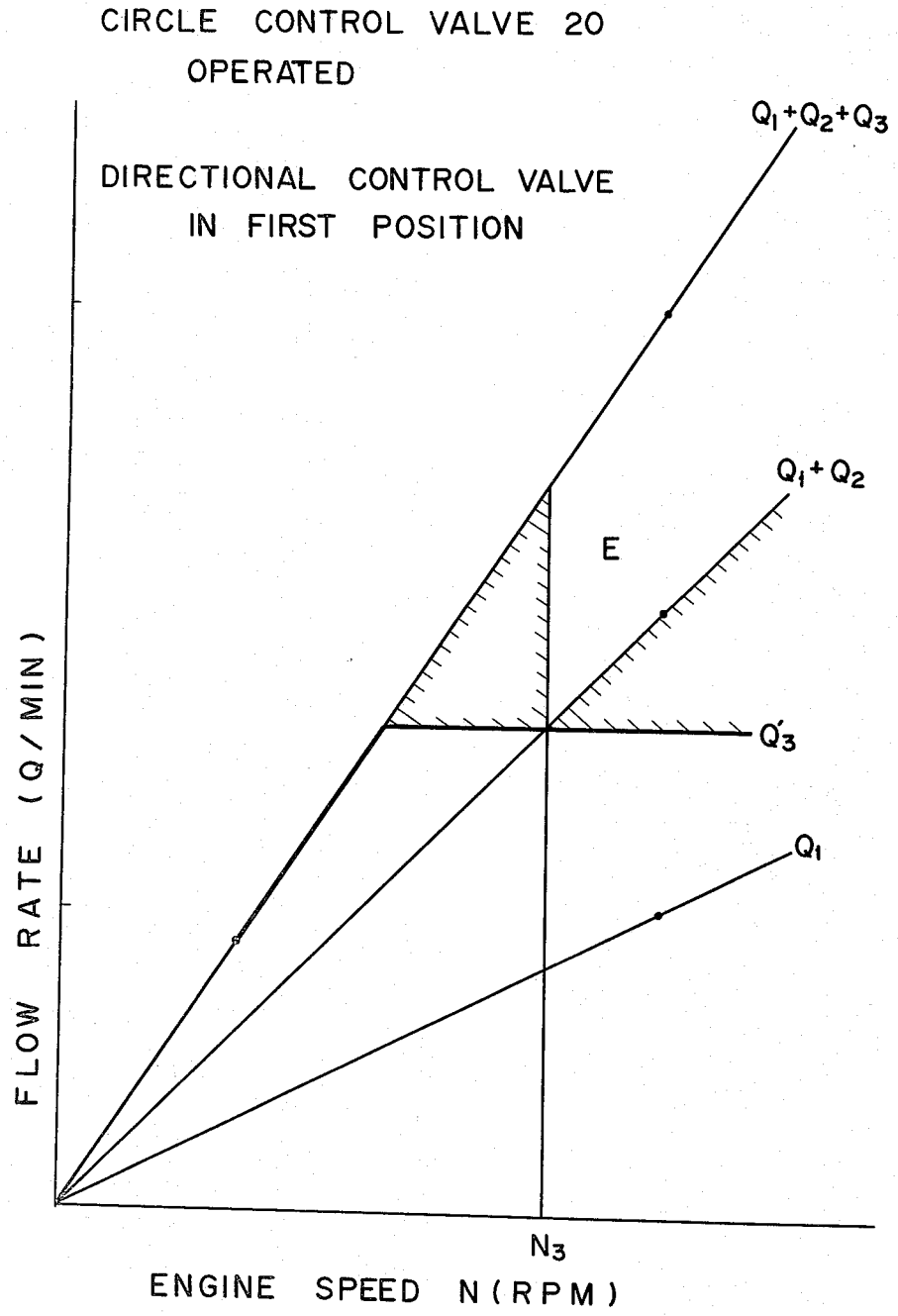
FIG. 4 is a graph explanatory of the performance of the power system when only the circle control valve is operated, with the directional control valve in the first position.

FIG. 4 graphically represents the above performance of the power system in relation to the circle drive motor 22. It will be noted that the Q3′ is constant regardless of engine speed or load when it is less than the sum of the pump outputs Q1, Q2 and Q3, so that the operating speed of the circle driven by the motor 22 is totally independent of engine speed or load in that range. When the engine speed N is less than N3 indicated in FIG. 4, the complete outputs Q1 and Q2 from the first 10 and second 12 pumps and part of the output Q3 from the third pump 14 are combined for delivery to the circle control valve 20. When the N is greater than N3, the complete output Q1 from the first pump 10 and part of the output Q2 from the second pump 12 are delivered in combination to the circle control valve, whereas the complete output Q3 from the third pump 14 is drained. The unloading of the third pump 14 results in the saving of power at E.

Figure 5:
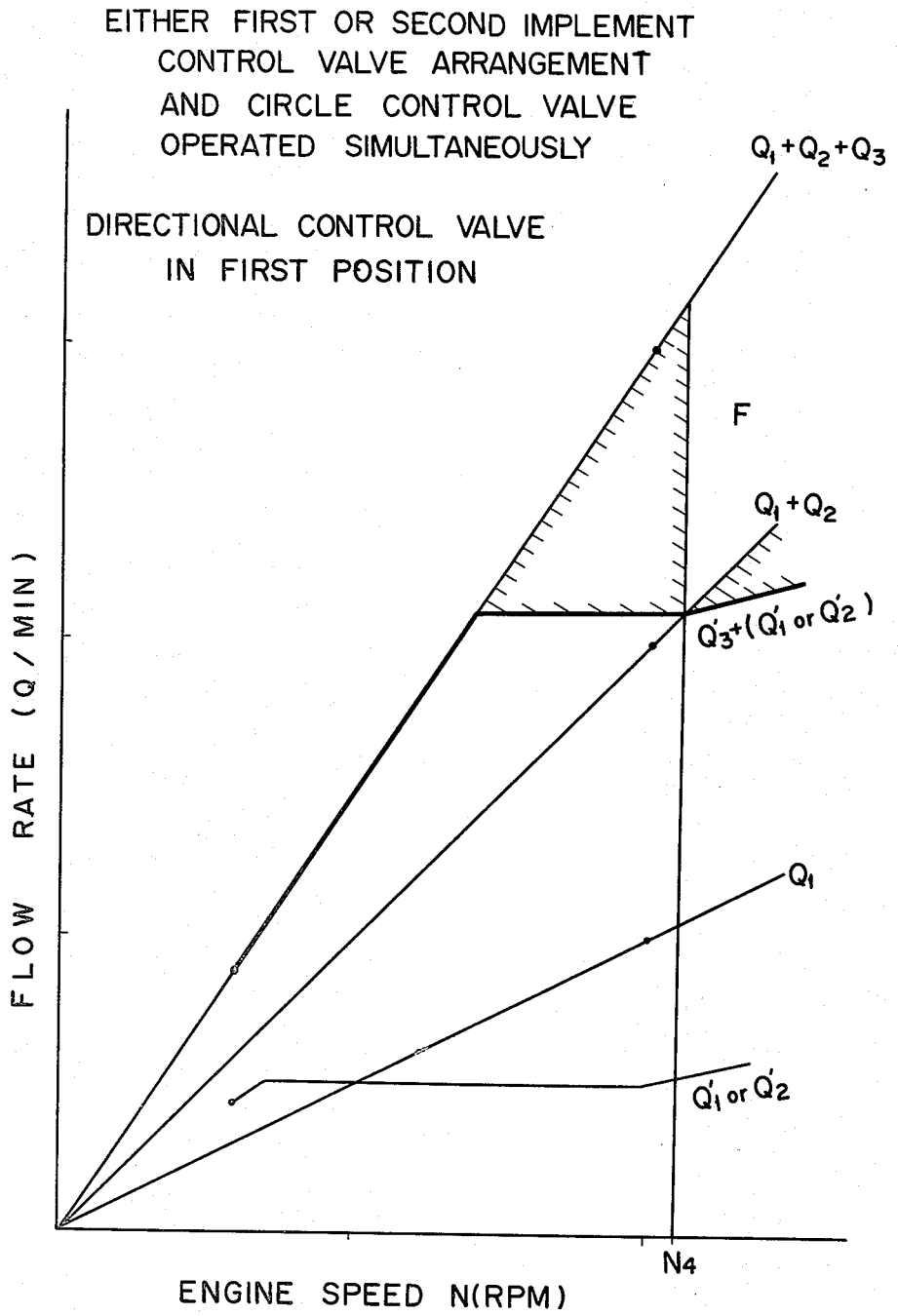
FIG. 5 is a graph explanatory of the performance of the power system when either of the first and second implement control valve arrangements and the circle control valve are operated simultaneously, with the directional control valve in the first position.
Figure 6:
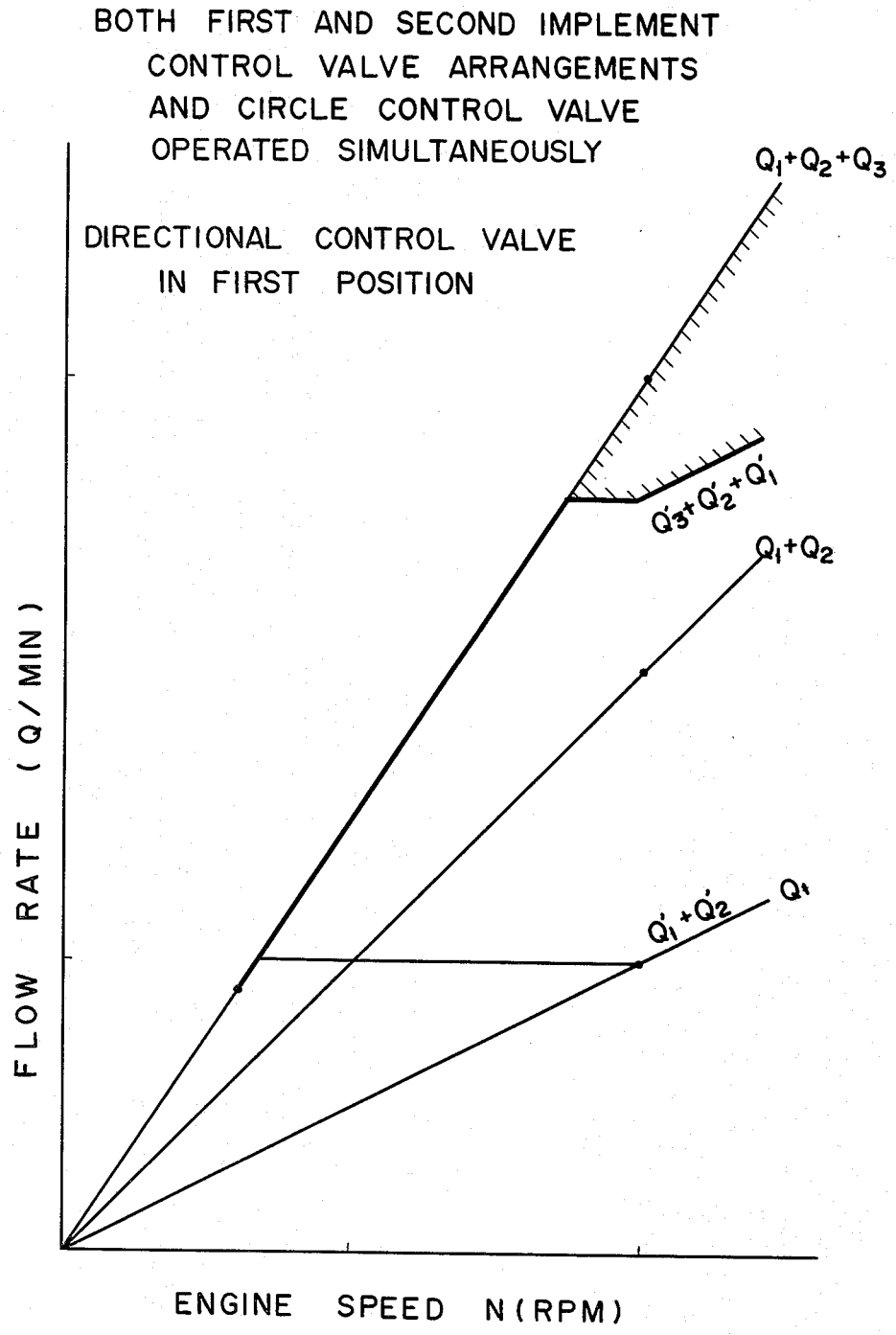
FIG. 6 is a graph explanatory of the performance of the power system when the first and second implement control valve arrangements and the circle control valve are all operated simultaneously, with the directional control valve in the first position.

The flow rates Q1′, Q2′ and Q3′ of the pressurized fluid to the implement control valve arrangements 16 and 18 and the circle control valve 20 are, within limits, constant and independent of loads imposed on the corresponding implement actuators even when the valve arrangements 16 and/or 18 and the valve 20 are operated simulataneously. FIG. 5 is a graphical summary of this power system when the control valve arrangement 16 or 18 and the control valve 20 are activated simultaneously, and FIG. 6 is a similar summary when the control valve arrangements 16 and 18 and the control valve 20 are all operated simultaneously. Power is saved at F. The simultaneous activation of either of the control valve arrangements 16 and 18 and the control valve 20 may be necessary as in side-shifting the blade and at the same time driving the circle. The simultaneous activation of both control valve arrangements 16 and 18 and the control valve 20 may be effected as in lifting or lowering the ends of the blade and at the same time driving the circle.

When the directional control valve 78 connected in one of the pilot circuits of the first demand valve 24 is manually shifted from the first 84 to second 86 position, the branch 80 of the conduit 30 is closed, and the pilot conduit 82 leading to the lower end of the demand valve is communicated with the fluid drain. Thereupon the fluid pressure upstream of the restriction 38 in the conduit 30 causes the first demand valve 24 to move to the fourth position 58 against the bias of the spring 60. The first demand valve 24 when in this fourth position closes the first outlet port 66 and intercommunicates the other three ports 62, 64 and 72. Since then only the output from the first pump 10 is allowed to pass the restriction 38, the Q0 (Q1′+Q2′) becomes equal to Q1.

Figure 7:
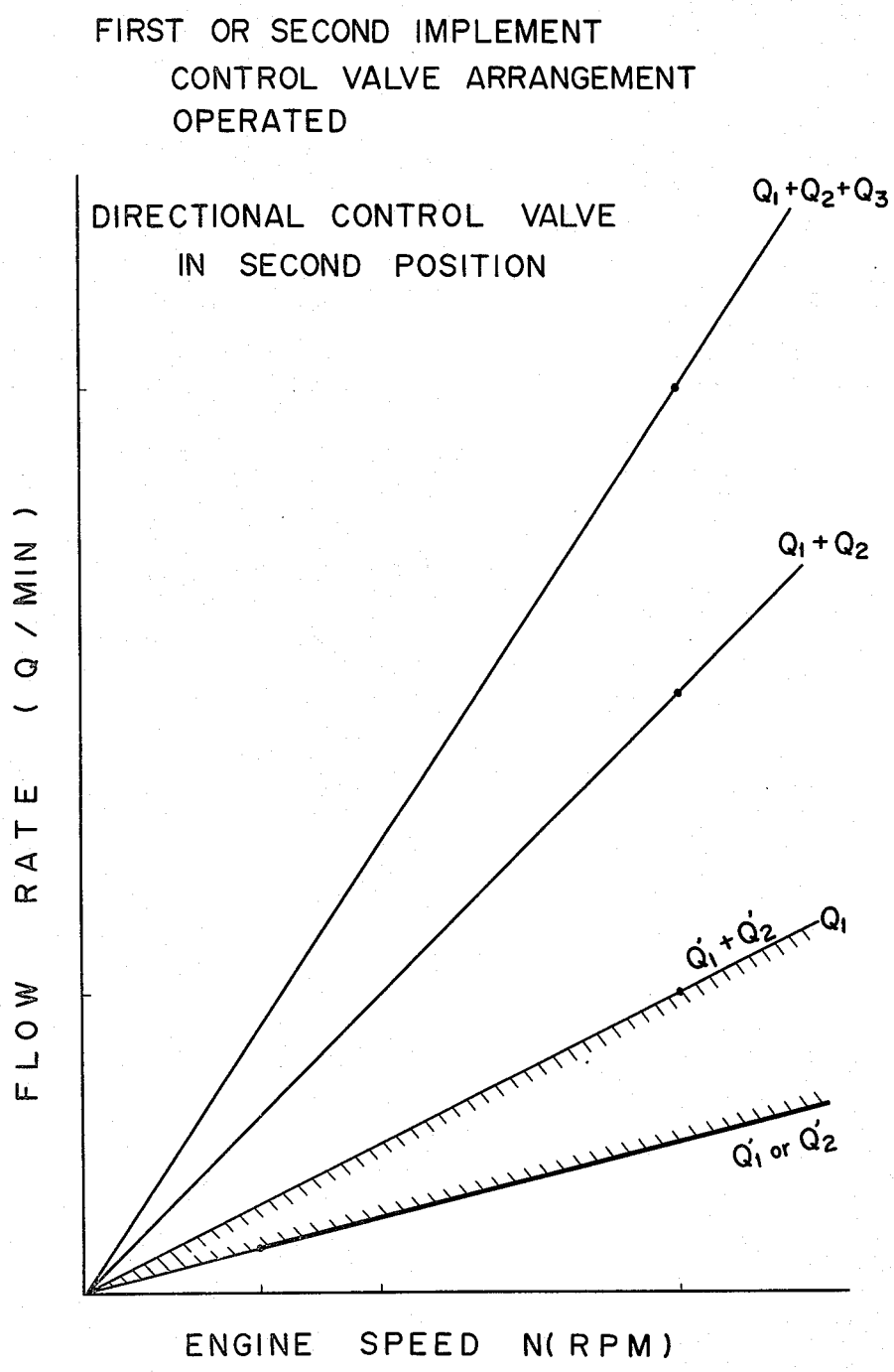
FIG. 7 is a graph explanatory of the performance of the power system when either of the first and second implement control valve arrangements is operated, with the directional control valve shifted to a second position.

FIG. 7 graphically represents such performance of the power system when the directional control valve 78 is in the second position 86. The graph demonstrates that the speed of the implement actuators under the control of the valve arrangements 16 and 18 is in direct proportion to engine speed. Such proportionality is desired as for manipulating the implements slowly, at speed corresponding to low engine speed. Unnecessarily quick implement movement can be a cause of trouble in some instances.

Figure 8:
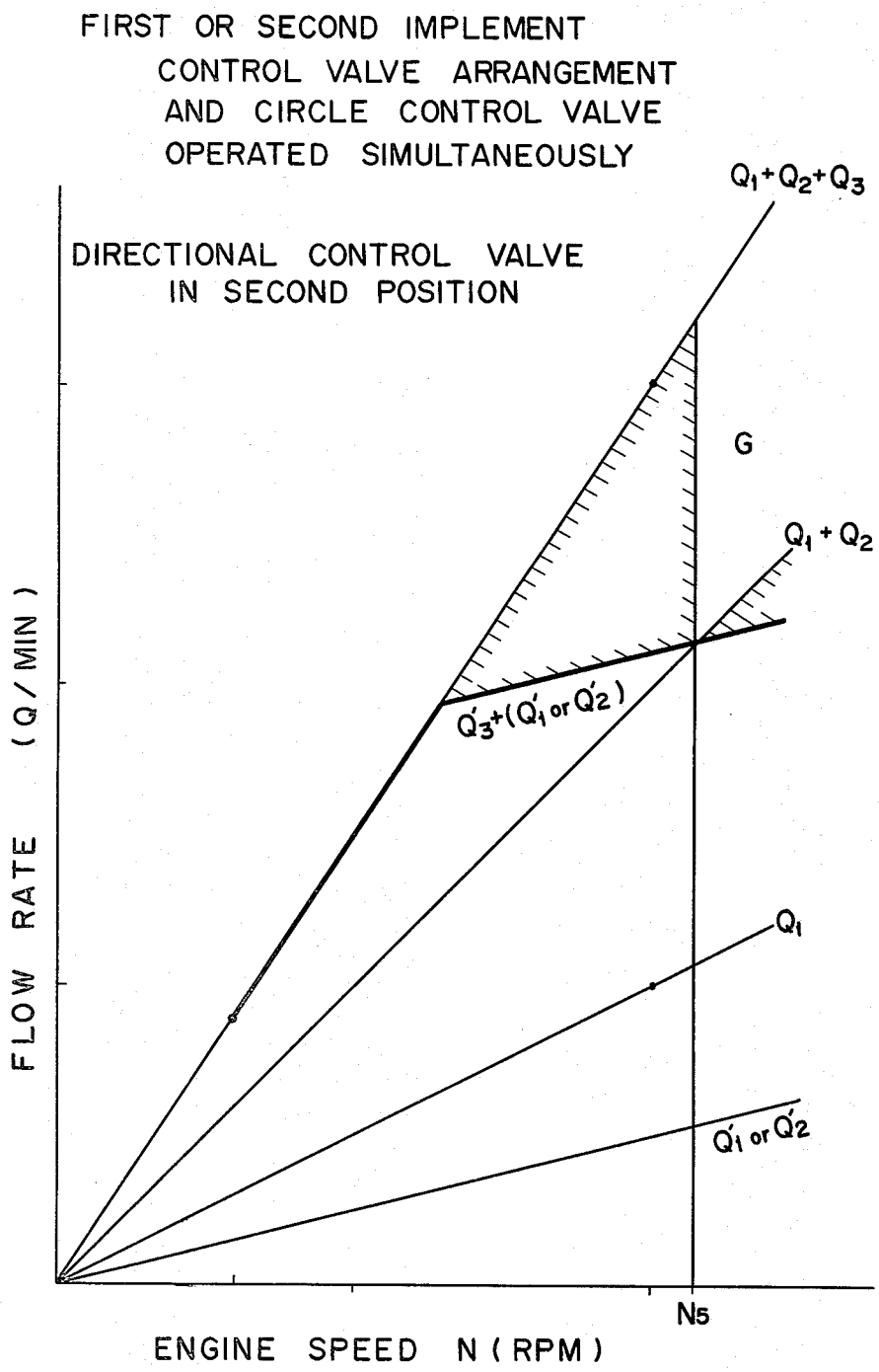
FIG. 8 is a graph explanatory of the performance of the power system when either of the first and second implement control valve arrangements and the circle control valve are operated simultaneously, with the directional control valve in the second position.
Figure 9:
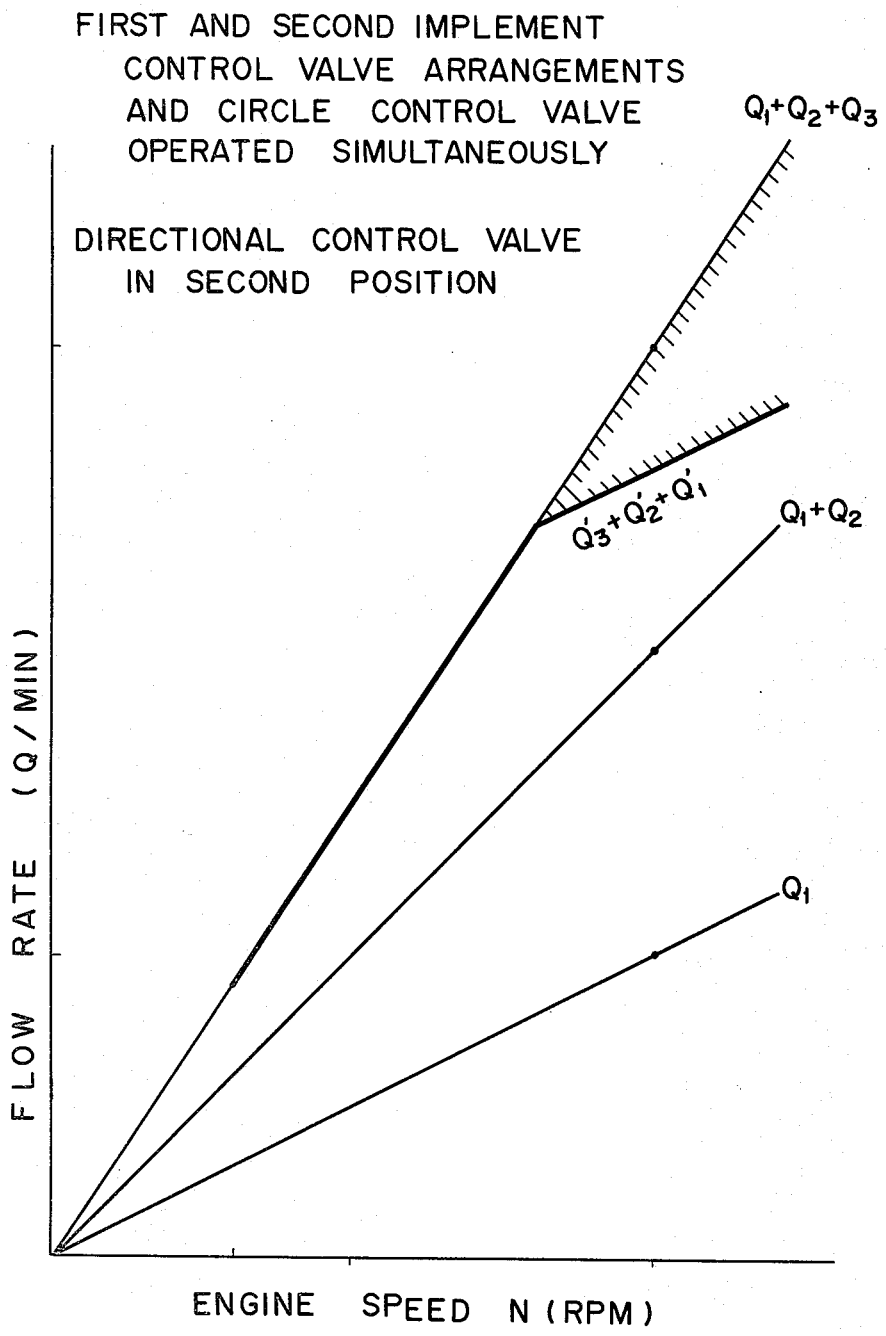
FIG. 9 is a graph explanatory of the performance of the power system when the first and second implement control valve arrangements and the circle control valve are all operated simultaneously, with the directional control valve in the second position.

The graph of FIG. 8 shows the performance of the power system when the implement control valve arrangement 16 or 18 and the circle control valve 20 are operated at the same time, with the directional control valve 78 in the second position 86. It will be noted from this graph that the third pump 14 is unloaded when the engine speed becomes higher than N5, resulting in the saving of power at G. FIG. 9 similarly plots the performance of the power system when the implement control valve arrangements 16 and 18 and the circle control valve 20 are all operated simultaneously, with the directional control valve 78 also in the second position 86.

During the above operation of the power system with the directional control valve 78 in the second position 86, the second demand valve 26 functions to maintain constant the fluid flow Q3′ downstream of the restriction 114, just as when the valve 78 is in the first position 84.

Upon manual shifting of the directional control valve 78 to the third position 88, both the branch 80 of the conduit 30 and the pilot conduit 82 leading to the lower end of the first demand valve 24 communicate with the fluid drain. Since then the entire outputs Q1, Q2 and Q3 from the three pumps 10, 12 and 14 are drained from the downstream side of the restriction 38, the pumps do not load the engine. The directional control valve 78 may therefore be moved to this third position in starting up the vehicle engine.

Figure 10:
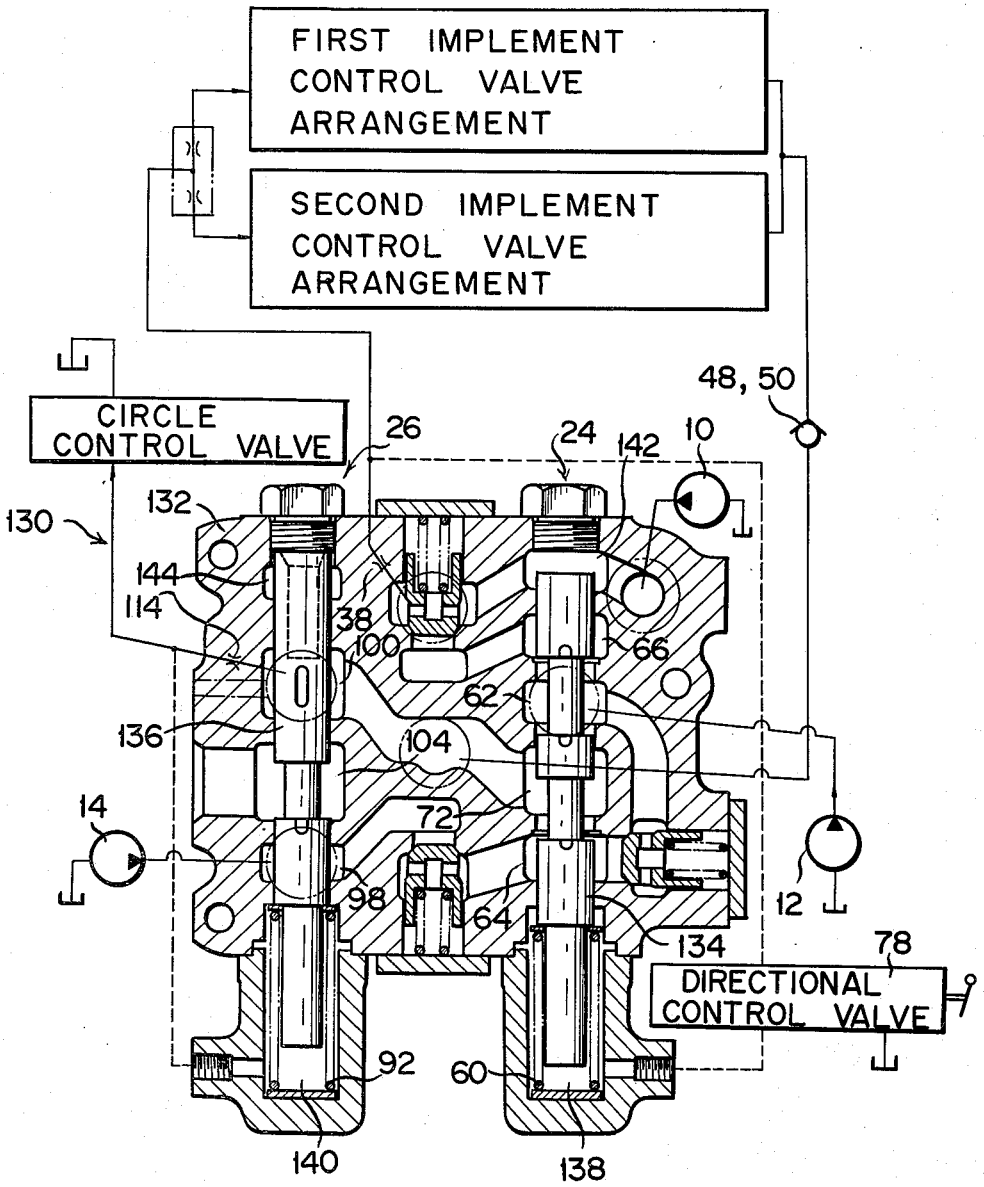
FIG. 10 is a sectional view of a dual demand valve assembly integrally comprising the first and second demand valves in the power system of FIG. 1, the valve assembly being shown together with a schematic representation of the other components of the power system.

In the practice of this invention the first 24 and second 26 demand valves of FIG. 1 may be conveniently combined into a single assembly. FIG. 10 illustrates an example of such dual demand valve assembly, generally designated 130, integrally comprising the two demand valves 24 and 26. The dual demand valve assembly 130 includes a valve body or housing 132 having reciprocably mounted therein a first spool 134 for the first demand valve 24 and a second spool 136 for the second demand valve 26 in parallel arrangement. Received in spring chambers 138 and 140, the springs 60 and 92 urge the valve spools 134 and 136 upwardly as viewed in this figure. The spring chamber 138 of the first demand valve 24 communicates with the downstream side of the restriction 38 via the direction control valve 78 to receive the pilot pressure signal. The spring chamber 140 of the second demand valve 26 communicates with the downstream side of the restriction 114 to receive the pilot pressure signal. Arranged opposite to the spring chambers 138 and 140 are pressure chambers 142 and 144 for receiving the pilot pressure signals from the upstream side of the restrictions 38 and 114, respectively. The first demand valve 24 is further provided with the four ports 62, 64, 66 and 72, and the second demand valve 26 with the four ports 98, 100 and 104, as shown.

The other details of construction of this dual demand valve assembly 130 will be understood upon inspection of FIG. 10, with reference also to FIG. 1. Its operation is also as set forth above.

While the hydraulic power system for implement actuators according to this invention has been disclosed as adapted specifically for a motor grader, it is understood that the system is applicable to other types of self-propelled work machines. It is also recognized that numerous changes and modifications may be made to conform to system requirements or design preferences, without departure from the spirit of the present invention as expressed in the following claims.

What we claim is:

1. A hydraulic power system for implement actuators in an off-highway self-propelled work machine such as a motor grader, the power system comprising:

(a) a plurality of sources of hydraulic fluid under pressure;

(b) at least two implement control valve means, one of the implement control valve means having a carry-over port;

(c) a first restriction formed in a first conduit extending from one of the pressurized fluid sources to said one implement control valve means;

(d) a first demand valve responsive to a pressure differential across the first restriction for maintaining constant fluid flow to said one implement control valve means by controlling communication between the rest of the pressurized fluid sources and said one implement control valve means;

(e) a second restriction formed in a second conduit extending from the first demand valve to the other of the implement control valve means, the carry-over port of said one implement control valve means being connected to the second conduit at a point upstream of the second restriction; and (f) a second demand valve responsive to a pressure differential across the second restriction for maintaining constant fluid flow to said other implement control valve means.

2. The hydraulic power system as recited in claim 1, wherein said one implement control valve means comprises:

(a) a first parallel implement control valve arrangement for controlling a first group of implement actuators that need not be operated simultaneously; and (b) a second parallel implement control valve arrangement, connected in parallel with the first parallel implement control valve arrangement, for controlling a second group of implement actuators that need not be operated simultaneously.

3. The hydraulic power system as recited in claims 1 or 2, wherein said other implement control valve means comprises an implement control valve for controlling an implement actuator that requires larger input flow than other implement actuators.

4. The hydraulic power system as recited in claim 1, further comprising a manually operated valve connected in a pilot circuit delivering a pilot pressure signal from the downstream side of the first restriction to the first demand valve, the manually operated valve being movable at least between a first position for permitting the delivery of the pilot pressure signal to the first demand valve and a second position for causing the first demand valve to block communication between said one implement control valve means and said rest of the pressurized fluid sources.

5. The hydraulic power system as recited in claim 4, wherein the manually operated valve is further movable to a third position for draining the output flow from all the pressurized fluid sources.

6. The hydraulic power system as recited in claim 1, wherein the first and the second demand valves are integrated into a dual demand valve assembly.

7. The hydraulic power system as recited in claim 1, wherein the pressurized fluid sources are fixed displacement pumps.

* * * * *